US006450210B2

(12) United States Patent
Schiller et al.

(10) Patent No.: US 6,450,210 B2
(45) Date of Patent: Sep. 17, 2002

(54) LINEAR MOTOR YARN-CUTTING DEVICE FOR MECHANICAL LOOMS

(75) Inventors: Peter Schiller, Lindau; Dieter Teufel, Langenargen, both of (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 09/811,783

(22) Filed: Mar. 20, 2001

(30) Foreign Application Priority Data

Mar. 20, 2000 (DE) ..... 100 14 366

(51) Int. Cl.[7] ..... D03D 49/70
(52) U.S. Cl. ..... 139/302; 26/10.4
(58) Field of Search ..... 139/302; 26/10.4

(56) References Cited

U.S. PATENT DOCUMENTS

| | | | | |
|---|---|---|---|---|
| 4,834,145 A | | 5/1989 | Lewyllie et al. | 139/429 |
| 4,834,147 A | | 5/1989 | Eberle et al. | 139/450 |
| 5,105,856 A | | 4/1992 | Wahhhoud | 139/194 |
| 5,158,119 A | * | 10/1992 | Pezzoli et al. | 139/434 |
| 5,398,732 A | * | 3/1995 | Zenoni et al. | 139/450 |
| 6,155,309 A | * | 12/2000 | Berktold | 139/450 |

FOREIGN PATENT DOCUMENTS

| | | |
|---|---|---|
| DE | 37 03 638 | 5/1988 |
| DE | 40 00 856 | 7/1991 |
| DE | 197 13 089 | 10/1998 |
| EP | 0 284 766 | 10/1988 |

* cited by examiner

*Primary Examiner*—Andy Falik
(74) *Attorney, Agent, or Firm*—Crowell & Moring LLP

(57) ABSTRACT

A yarn cutting device for mechanical looms, having two mutually movable blades which are arranged on a mounting surface, at least one of the blades being operable by a drive. The drive is constructed as an electrically energized linear motor, whereby a compact flat construction is achieved which has few movable parts. One of the blade carriers is a rotor of the linear motor.

9 Claims, 2 Drawing Sheets

LINEAR MOTOR YARN-CUTTING DEVICE FOR MECHANICAL LOOMS

BACKGROUND AND SUMMARY OF THE INVENTION

This application claims the priority of German Patent Document 100 14 366.0, filed Mar. 20, 2000, the disclosure of which is expressly incorporated by reference herein.

The invention relates to a yarn cutting device for mechanical looms having a first blade carrier with an end-side blade and a second blade carrier with an end-side blade, at least one of said blade carriers being in an operative connection with a drive in order to carry out a yarn cutting function between the blades.

In the case of mechanical looms, the woof yarn is withdrawn from supply coils, is fed to a woof element and is fed by the latter into the shed. In the area of the selvages, special yarn cutting devices are provided which cut off the woof yarn withdrawn from the supply coil, fed into the shed and looped by hand to the selvage. Yarn cutting devices are also used for cutting off yarn projections on the selvages. For example, scissors are used as woof yarn cutting devices which are arranged close to the selvage. Scissors are known which are driven directly mechanically by the mechanical loom as well as those which are operated by a separate electric-motor drive or a pneumatic drive.

In German Patent Document DE-PS 37 03 638, a woof yarn cutting device is disclosed with a stationary scissors part and a scissors part movable by an eccentric arrangement, the eccentric arrangement being coupled with the main drive of the mechanical loom and being operated by the latter.

From German Patent Document DE 40 00 856 A1, a yarn cutting device is known for cutting off the fed woof yarn in the case of mechanical looms, which is mechanically coupled by way of a cam mechanism or the like also with the main drive of the mechanical loom. The yarn cutting device operates synchronously with respect to the loom rhythm. The point in time of the cutting operation is therefore firmly defined with respect to the weaving cycle and cannot be changed or can be changed only by major mechanical modifications.

A significantly more flexible cutting device for woof yarns is known from European Patent Document EP 0 284 766 B1. This cutting device has a drive which is independent of the main drive, so that the point in time of the cutting operation with respect to the weaving cycle can be arbitrarily defined by means of a programmable control. The drive consists of a stepping motor on whose shaft the movable blade is fastened, the stepping motor being driven in an oscillating manner in both rotating directions. However, the oscillating drive has the disadvantage that the stepping motor is subjected to high stress and high wear by continuous acceleration and braking operations. Furthermore, the cutting device is not monitored with respect to the operation or with respect to damage.

In German Patent Document DE 197 13 089 A1, similar yarn scissors are disclosed driven by a stepping motor in mechanical looms, in which case, however, the stepping motor is not driven in an oscillating manner but permanently in one rotating direction. This reduces the wear and the stress of the motor in comparison to the cutting device according to European Patent Document EP 0 284 766.

Disadvantages of the above-mentioned constructions of cutting devices with the above-mentioned drives are, for example, the high space requirement and the fact that the devices for the mechanical power transmission to the at least one shears part are subjected to relatively high wear.

An object of the present invention is to provide a yarn cutting device for mechanical looms which operates with relatively little wear while the space requirements are low.

According to the invention, this object is achieved by a yarn cutting device for mechanical looms having a first blade carrier with an end-side blade and a second blade carrier with an end-side blade, at least one of said blade carriers being in an operative connection with a drive in order to carry out a yarn cutting function between the blades, wherein the drive is constructed as an electrically energized linear motor.

The invention provides that the drive of the yarn cutting device is constructed as an electrically energized linear motor.

According to the invention, a compact flat construction of the yarn cutting device is achieved with reduced friction, a small play and a favorable pivot position of the blade carriers. Another advantage is the high starting thrust of linear motors which reaches it maximal value immediately after the switching-on of the motor.

Preferred embodiments and further developments of the invention are indicated in the dependent claims.

In a preferred embodiment according to the invention, it is provided that one of the blades is arranged on a blade carrier which is stationary with respect to the mounting surface of the yarn cutting device but can preferably be adjusted in its position.

In another advantageous embodiment of the invention, it is provided that at least one of the blades is arranged on a linearly movable blade carrier which can be operated by the linear motor. The blade of this linearly moved blade carrier is moved with respect to the blade of the other, preferably fixedly arranged blade carrier between an open position and a closed position. In this case, the moving direction of the moved blade carrier, thus the dynamic effect of the linear motor, coincides approximately with the longitudinal axis of the blade carrier.

In another embodiment of the invention, at least one of the blades is arranged on a blade carrier rotatably disposed in a pivot, the rotatably disposed blade carrier being movable by the linear motor. The moving direction of the rotatable blade carrier, thus, the dynamic effect of the linear motor, is directed essentially perpendicularly to the longitudinal axis of the blade carrier.

It can also be provided that both blade carriers of the yarn cutting device are linearly movable with respect to one another by one linear motor respectively.

In another embodiment, both blade carriers can be disposed in one pivot and can be moved by one linear motor respectively.

As a further development of the invention, it is provided that, for monitoring the position of at least one of the blades or blade carriers, the yarn cutting device is equipped with a path measuring system. For this purpose, the path measuring system may be integrated in the linear motor or may be coupled directly with the movable blade carrier or carriers.

Other objects, advantages and novel features of the present invention will become apparent from the following detailed description of the invention when considered in conjunction with the accompanying drawings.

DETAILED DESCRIPTION OF THE DRAWINGS

Figure 2:
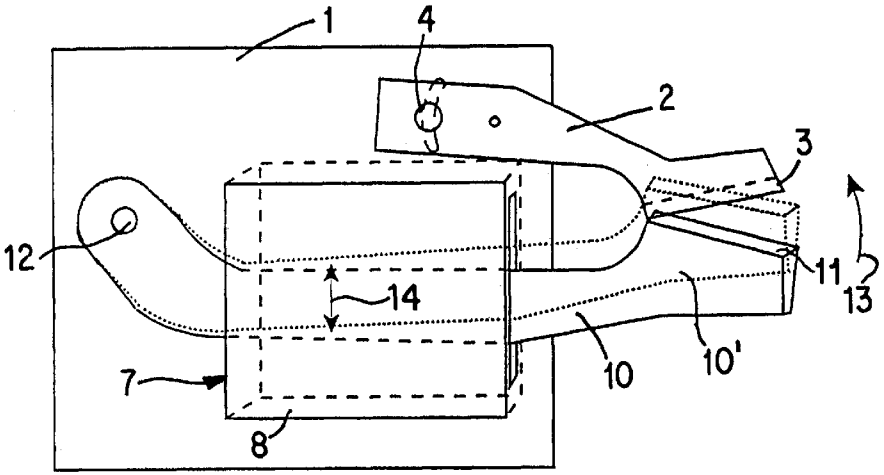
FIG. 2 is a lateral view of a second embodiment of the yarn cutting device.

A first embodiment of the yarn cutting device comprises a mounting surface 1 on which a stationary blade carrier 2 is arranged which carries a blade 3. A blade 6 of a second movable blade carrier 5 interacts with the blade 3 of the first stationary blade carrier 2, the movable blade carrier 5 being moved back and forth in an oscillating manner by a linear motor 7. The stator 8 of the linear motor 7 is fastened on the mounting surface 1, in which case the rotor of the linear motor 7 is formed by the blade carrier 5 which can be moved back and forth in the direction of the arrow 9.

A path measuring system 24 may be integrated in the linear motor 7 and control and regulate the position, the moving direction and the speed of the movement of the blade carrier 5.

Figure 3:
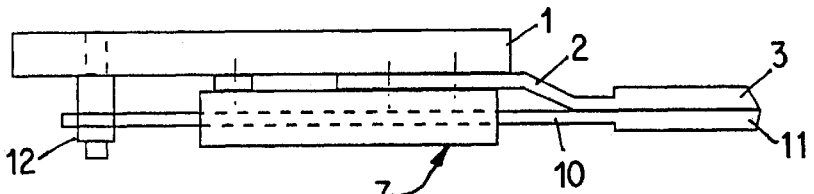
FIG. 3 is a top view of the embodiment according to FIG. 2.
Figure 1:
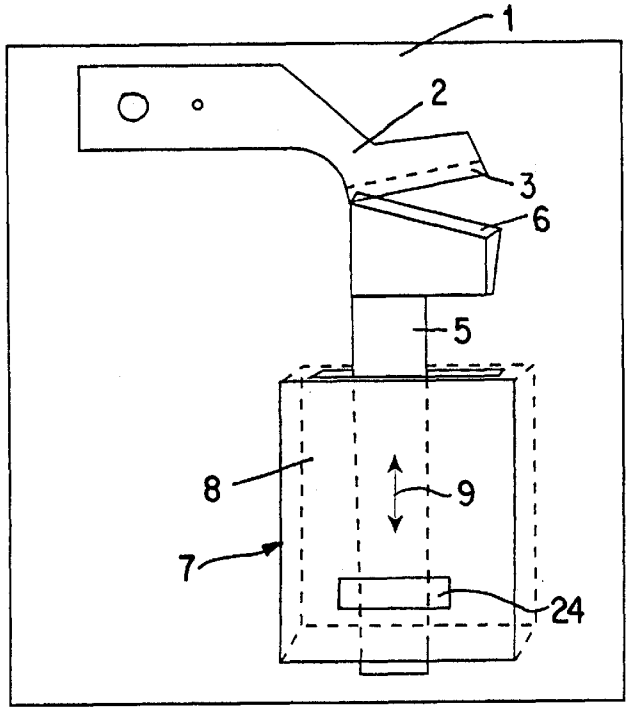
FIG. 1 is a lateral view of a first embodiment of the yarn cutting device.

FIGS. 2 and 3 show another embodiment of the invention with a blade carrier 2 is stationarily arranged on the mounting surface 1 and which is disposed in a pivot 4 so that it can be adjusted in its position as required. In another pivot 12, a movable blade carrier 10 is disposed which forms the rotor of the linear motor 7. The stator 8 of the linear motor 7 is in turn fixedly fastened on the mounting surface 1. During the operation of the linear motor 7, the blade carrier 10 is swivelled by a certain amount about the pivot 12 and thus carries out the cutting movement of the blades 3, 11 of the two blade carriers 2, 10, as indicated by a broken line by position 10' of the blade carrier 10. The cutting movement is carried out in the direction of the arrow 13, in which case the moving direction 14 of the blade carrier 10 in this case is essentially perpendicular to the longitudinal axis of the blade carrier 10.

In the two above-described embodiments, the yarn cutting devices each have only one movable blade. In the embodiment according to FIGS. 4 to 6, a yarn cutting device is illustrated which has two movable blades 16, 18. The movable blades 16, 18 are arranged on the blade carriers 15, 17 disposed in the pivot 19, in which case the blade carriers 15, 17 can naturally also be disposed in separate pivots.

For operating the blade carriers 15, 17, a linear motor 20 is again provided, in which case the blade carriers 15, 17 are each constructed as rotors of the linear motor. The linear motor 20 should be constructed such that, when it is energized, the blade carriers 15, 17 always move oppositely in the direction of the arrow 21 and 22 in order to ensure a cutting movement of the blades 16, 18 in the direction of the arrow 23. When an electric linear motor is used, this can be achieved by the corresponding construction of the stator or by separate stators which act upon the blade carriers 15, 17.

Figure 5:
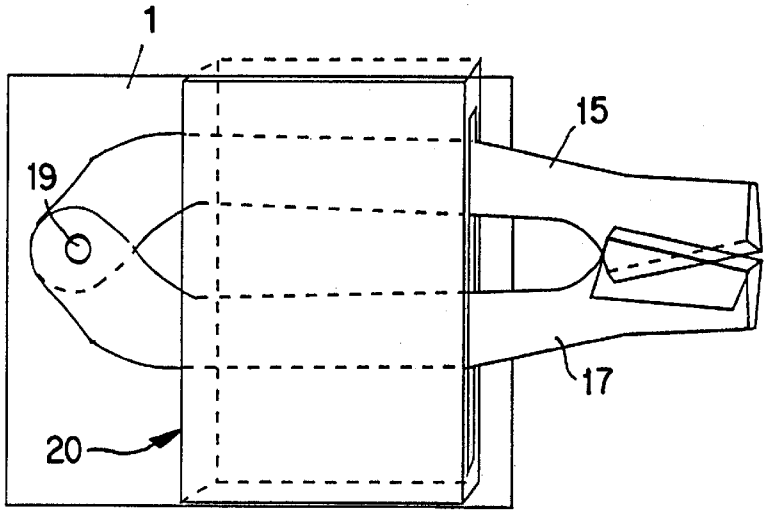
FIG. 5 is a view of the embodiment according to FIG. 4 in the closed position of the blades.
Figure 4:
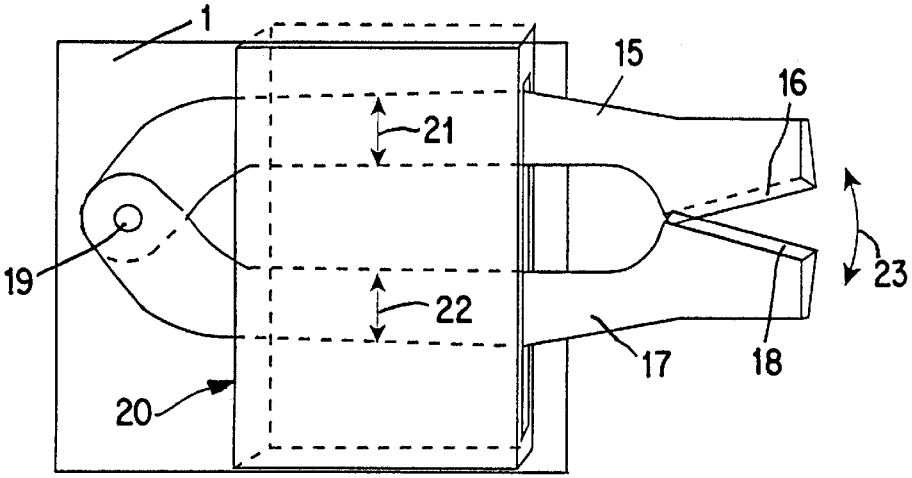
FIG. 4 is a lateral view a third embodiment of the yarn cutting device in the open position of the blades.
Figure 6:
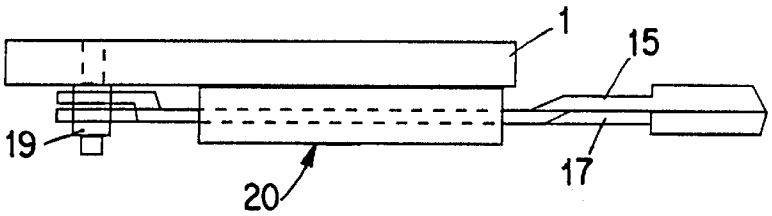
FIG. 6 is a top view of the embodiment according to FIGS. 4 and 5.

FIG. 4 shows the cutting device in the opened condition; whereas FIG. 5 shows the cutting device in the closed condition. The linear motors 7, 20 according to the embodiment are illustrated only schematically because a person skilled in the art is familiar with the construction and the method of operation of linear motors.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Yarn cutting device for mechanical looms having a first blade carrier with an end-side blade and a second blade carrier with an end-side blade, at least one of said blade carriers being in an operative connection with a drive in order to carry out a yarn cutting function between the blades, wherein the drive is constructed as an electrically energized linear motor, and wherein the first blade carrier is stationarily arranged on a mounting surface, in that the linear motor is arranged in an angularly displaced manner with respect to the first blade carrier on the mounting surface, and the at least one of said blade carriers is a rotor of the linear motor.

2. Yarn cutting device according to claim 1, wherein the linear motor has a path measuring system for monitoring positions of the blade carriers.

3. Yarn cutting device, for mechanical looms having a first blade carrier with an end-side blade and a second blade carrier with an end-side blade, at least one of said blade carriers being in an operative connection with a drive in order to carry out a yarn cutting function between the blades, wherein the drive is constructed as an electrically energized linear motor, wherein the at least one of said blade carrier, at an end facing away from the blade, is disposed to be swivellable about a fixed axis on a mounting surface, and wherein the linear motor, spaced away from the axis, causes the at least one of said blade carriers to carry out an oscillating back-and-forth motion, the at least one of said blade carriers being a rotor of the linear motor.

4. Yarn cutting device according to claim 3, wherein the linear motor has a path measuring system for monitoring positions of the blade carriers.

5. Yarn cutting device, for mechanical looms having a first blade carrier with an end-side blade and a second blade carrier with an end-side blade, at least one of said blade carriers being in an operative connection with a drive in order to carry out a yarn cutting function between the blades, wherein the drive is constructed as an electrically energized linear motor, wherein the linear motor has a path measuring system for monitoring positions of the blade carriers.

6. A blade assembly, of a mechanical loom for cutting yarn comprising:

a first blade carrier with a first blade arranged at one end, a second blade carrier with a second blade arranged at one end, and an electrically energized linear motor operatively connected to at least one of the blade carriers to cut yarn between the blades, wherein the first blade carrier and a stator of the linear motor are stationarily arranged on a mounting surface, and the,second blade carrier is a rotor of the linear motor.

7. A blade assembly, of a mechanical loom for cutting yarn comprising:

a first blade carrier with a first blade arranged at one end, a second blade carrier with a second blade arranged at one end, and an electrically energized linear motor operatively connected to at least one of the blade carriers to cut yarn between the blades, wherein the linear motor has a path measuring system for monitoring positions of the at least one of the blade carriers, the at lest one of the blade carriers being a rotor of the linear motor.

8. A method, of making a yarn cutting device for mechanical looms comprising:

constructing a drive as an electrically energized linear motor, providing a first blade carrier with an end-side blade, providing a second blade carrier with a second end-side blade, operatively connecting at least one of said blade carriers with the drive in order to carry out a yarn cutting function between the blades, the at least one of the blade carriers being a rotor of the linear motor and stationarily arranging the first blade carrier and the motor arranged on a mounting surface.

9. A method, of cutting yarn in a mechanical loom comprising:

constructing a drive as an electrically energized linear motor, providing a first blade carrier with a blade arranged at one end of the first blade carrier, providing a second blade carrier with a second blade arranged at one end of the second blade carrier, providing the drive operatively connected with at least one of said blade carriers in order to carry out a yarn cutting function, cutting said yarn between said blades upon operation of said drive, stationarily arranging the first blade carrier on a mounting surface, in that the linear motor is arranged in an angularly displaced manner with respect to the first blade carrier on the mounting surface, and providing the at least one of said blade carriers as a rotor of the linear motor.

* * * * *